US005573110A

United States Patent [19]

Nguyen

[11] Patent Number: 5,573,110

[45] Date of Patent: Nov. 12, 1996

[54] GAME CARD HOLDER

[75] Inventor: Viet Nguyen, Boonton, N.J.

[73] Assignee: Advanced Products Development, Inc., Morristown, N.J.

[21] Appl. No.: 57,178

[22] Filed: May 3, 1993

[51] Int. Cl.[6] ..... B65D 11/18

[52] U.S. Cl. ..... 206/39; 206/39.3; 150/147; 383/38; 383/39

[58] Field of Search ..... 206/39, 39.1–39.7; 150/149, 148, 140, 147; 383/86, 38, 39, 40

[56] References Cited

U.S. PATENT DOCUMENTS

| | | | |
|---|---|---|---|
| 258,196 | 5/1882 | Cross | 206/39.6 |
| 1,211,025 | 1/1917 | Wright | 383/38 X |
| 1,222,254 | 4/1917 | Adams | 383/86 X |
| 1,506,926 | 9/1924 | Gunter | 383/86 X |
| 1,792,582 | 2/1931 | Goldsmith | 383/38 X |
| 4,978,055 | 12/1990 | Miller | 150/147 X |
| 5,149,137 | 9/1992 | Holt | 206/39.1 |

FOREIGN PATENT DOCUMENTS

| | | | |
|---|---|---|---|
| 1445608 | 6/1966 | France | 150/150 |
| 365318 | 12/1962 | Switzerland | 150/149 |

*Primary Examiner*—David T. Fidei
*Attorney, Agent, or Firm*—Ernest D. Buff

[57] ABSTRACT

A game care holder for storing and viewing lottery tickets has a heat-sealed, multi-pocket pouch comprising a plurality of die cut pieces of flexible, opaque, and clear vinyls. The pouch has a larger pocket provided with a divider, which creates a two pocket effect, and one or more smaller pockets for small game cards and business cards. A closing flap of the holder is inserted into a belt loop to contain and protect the contents of the pouch.

16 Claims, 7 Drawing Sheets

GAME CARD HOLDER

BACKGROUND OF THE INVENTION

1. Field of the Invention

The present invention provides a document holder for ticket storage; and more particularly, to a lottery card holder for storing, protecting and viewing lottery tickets and boards used in game play.

2. Description of the Prior Art

State lotteries are increasingly popular and, due to the various different games that make up an individual state's lottery, there are usually different sizes of tickets. If a ticket has been folded or mutilated, the lottery machine will register wrong numbers, or reject the ticket, making manual entry necessary. A conventional man's wallet or a women's handbag is inadequate for proper storage of lottery tickets. Such devices are relatively expensive and do not permit lottery and game boards to be stored and protected in an environment where they can be readily viewed.

U.S. Pat. No. 4,978,055 discloses a reinforced pocket structure for thermo-adhesive materials, and specifically provides for a reinforced weld having increased resistance to tearing at the corners of the openings of pockets formed by high frequency pressure welding techniques. The holders disclosed therein are not suited for storing and viewing tickets and boards used in lottery games.

SUMMARY OF THE INVENTION

The present invention provides a game card holder for storing, protecting and viewing lottery tickets and game boards. Generally stated, the game card holder has a heat-sealed multi-pocket pouch comprising a plurality of die cut pieces of flexible, opaque and clear vinyls. A larger pocket of the pouch is provided with a divider adapted to create a two pocket effect. The pouch additionally comprises one or more smaller pockets. A closing flap of the holder is adapted for insertion into a belt loop to contain and protect the contents of the pouch.

The game card holder comprises: an outer cover having a crease and a folding flap; a first pocket cover permanently bound along three edges to the outer cover and defining therewith a first pocket having an opening therein for receiving a plurality of large game cards, the first pocket cover having a length substantially equal to the length of the outer cover minus the length of the flap; a second pocket cover permanently bound along three edges to the first pocket cover and forming therewith a second pocket for receiving a plurality of small game cards, the second pocket having a length less than the length of the first pocket. Optionally, the game card holder further comprises a pocket divider having a pair of opposing edges permanently bound between the outer cover and the first pocket cover, for dividing the opening of the first pocket in two. Other variations of the game card holder, including number, size, and position of pockets are encompassed within this invention.

Further, the invention provides for a process for fabricating a game card holder.

Advantageously, the game card holder of the present invention protects lottery tickets from physical abuse such as wear, inadvertent bending or folding, and moisture, while allowing easy insertion, removal, and viewing. This protection is provided for a plurality of ticket sizes. Preservation of tickets and game boards is markedly improved, and incidences involving wrong numbers or rejections of the ticket by lottery machines are virtually eliminated.

BRIEF DESCRIPTION OF THE DRAWINGS

The invention will be more fully understood and further advantages will become apparent when reference is made to the following detailed description of the preferred embodiment of the invention and the accompanying drawings, in which.

DESCRIPTION OF PREFERRED EMBODIMENTS

Figure 1:
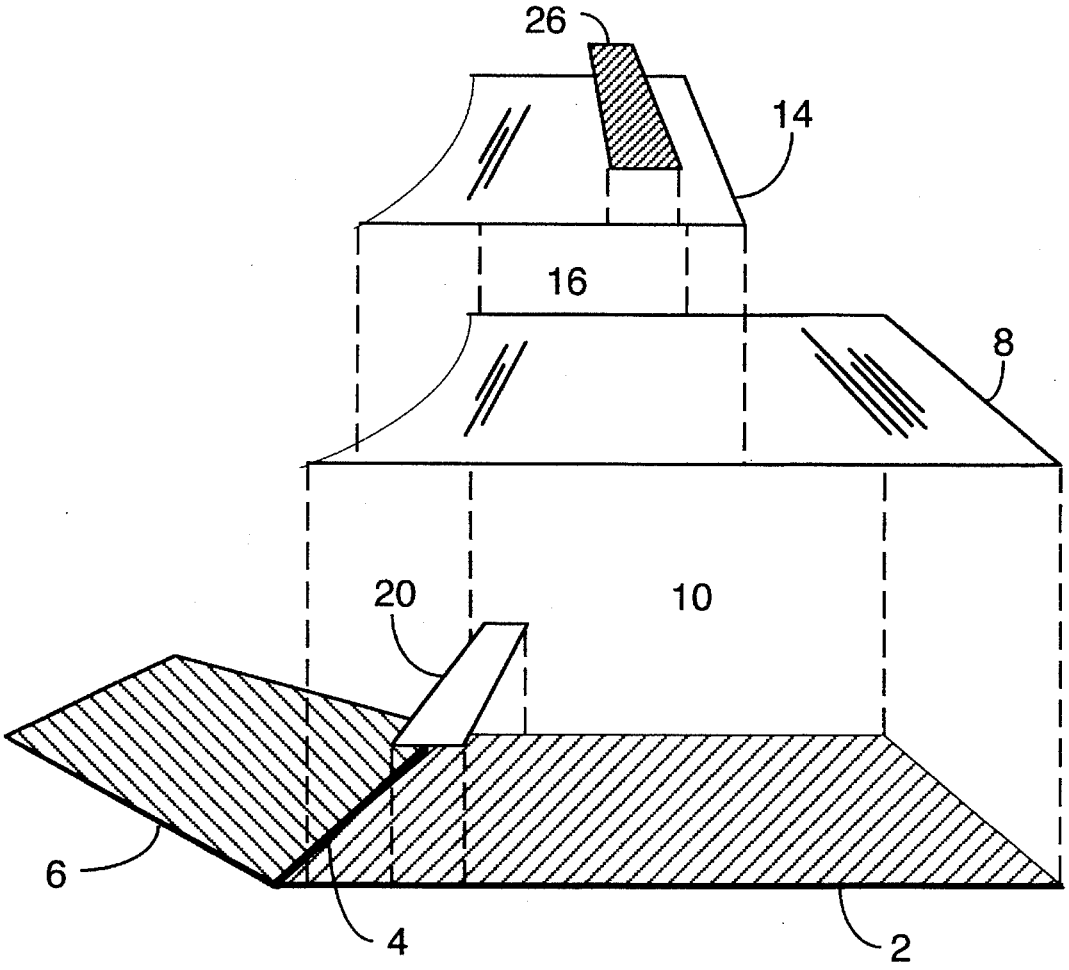
FIG. 1. is an exploded view of a two pocket game card holder.
Figure 2:
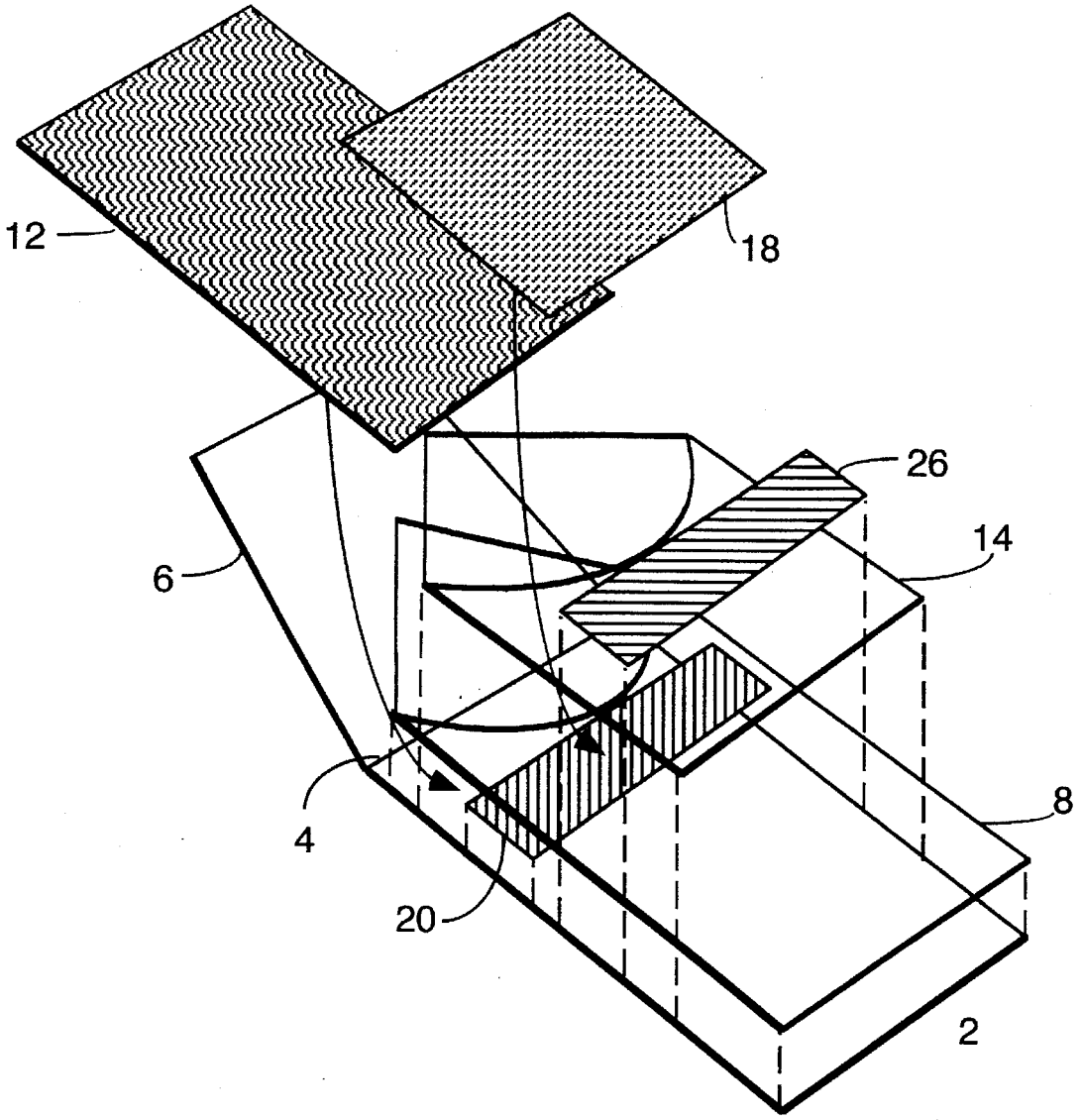
FIG. 2 is an exploded view of a two pocket game card holder and lottery cards.
Figure 3:
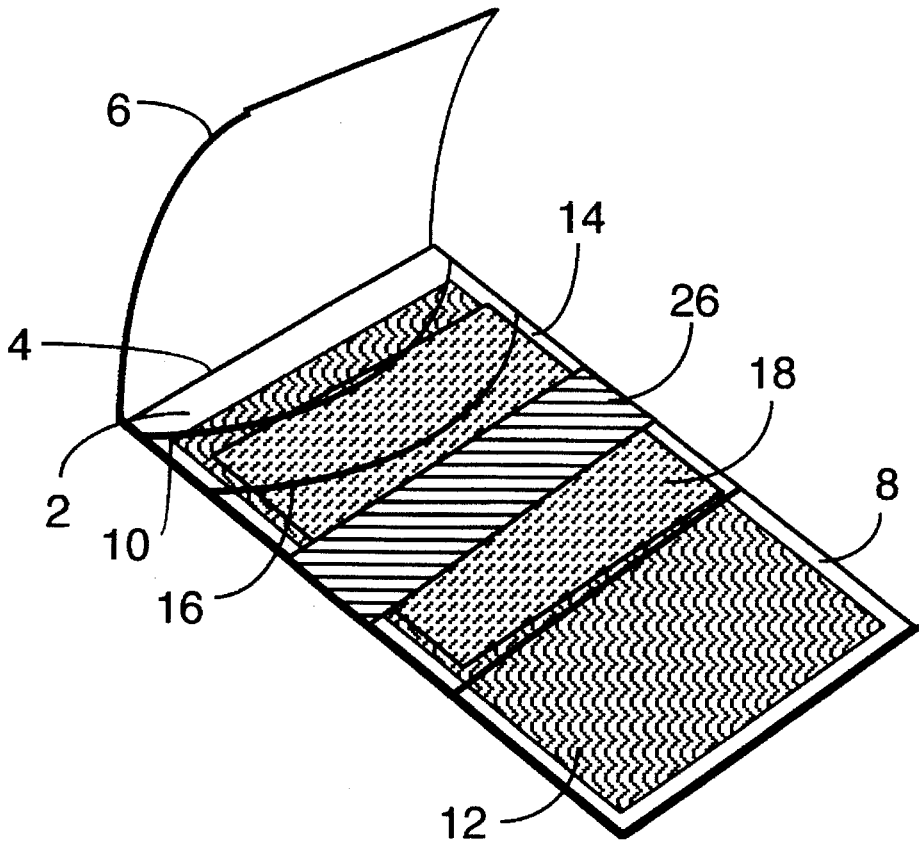
FIG. 3 is a perspective view of a game card holder with folding flap open.
Figure 4:
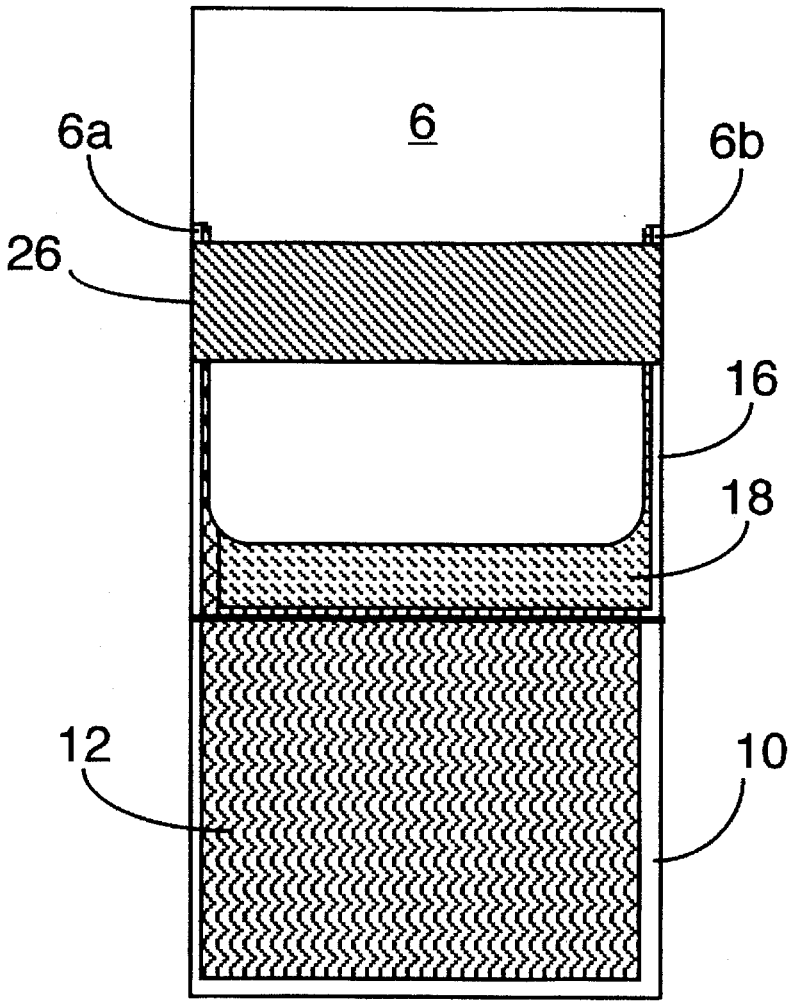
FIG. 4 is a frontal view of a game card holder with folding flap closed into belt loop.

Referring to FIGS. 1 through 4 of the drawings, there is shown a game card holder of the present invention. In the preferred embodiment, the game card holder 11, comprises an outer cover 2 having a folding crease 4 and folding flap 6; a first pocket cover 8 permanently bound along three edges to the outer cover 2 forms therewith a first pocket 10 for receiving a plurality of large game cards 12. The first pocket cover 8 has a length nearly equal to the length of the outer cover 2 minus the length of the folding flap 6. A second pocket cover 14 is permanently bound along three edges to the first pocket cover 8, and forms therewith a second pocket 16 for receiving a plurality of small game cards 18. The second pocket 16 has a length less than the first pocket 10. Optionally, the game card holder 11 further comprises a belt loop 26 for receiving the folding flap 6. As another option, the game card holder 11 comprises still further a pocket divider 20 having a pair of opposing edges permanently bound between the outer cover 2 and the first pocket cover 8 for dividing the opening of the first pocket 10 in two. As a further option, flap 6 is provided with an indented portions, shown as **6*a* and 6*b* in FIG. 4, thereby facilitating the insertion of flap 6 under belt loop 26. Indents 6*a* and 6*b* further provide a means for ensuring that flap 6 is folded at crease 4**.

In an alternative embodiment of the invention, the second pocket cover 14 is located on the opposite side of the outer cover 2 from the first pocket 10. Specifically, the second pocket cover 14 is permanently bound along three edges to the side of the outer cover 2 which is opposite to the first pocket cover 8, thereby forming a second pocket 10 for receiving a plurality of small game cards 18.

Figure 5:
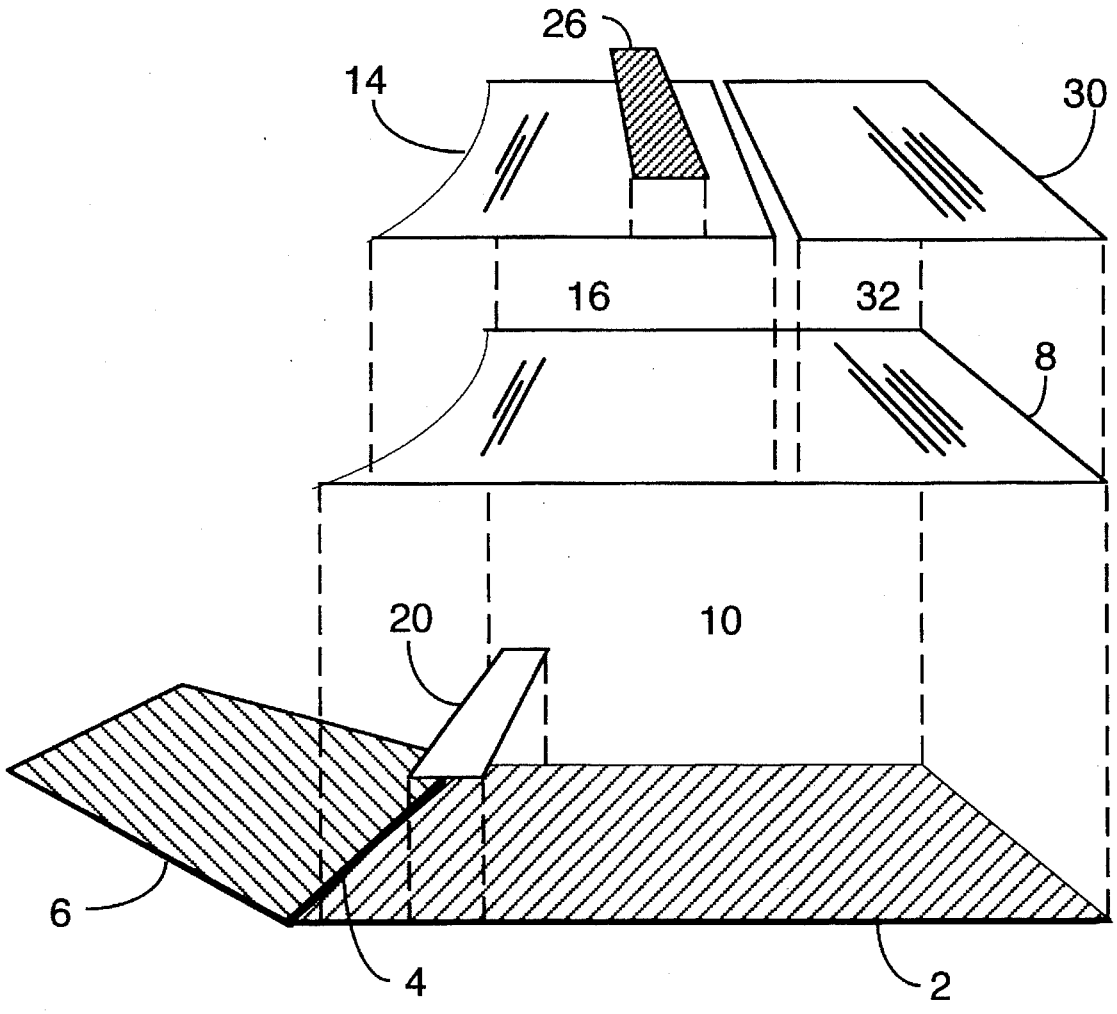
FIG. 5 is an exploded view of a three pocket game card holder.

In another embodiment of the present invention, as shown in FIG. 5, there is provided a third pocket cover 30 permanently bound along three edges to the first pocket cover 8, forming a third pocket 32 for receiving a plurality of business cards 34. In this embodiment the combined length of second pocket cover 14 and third pocket cover 30 is, at most, equal to the length of outer cover 2 minus the length of flap 6.

Figure 6:
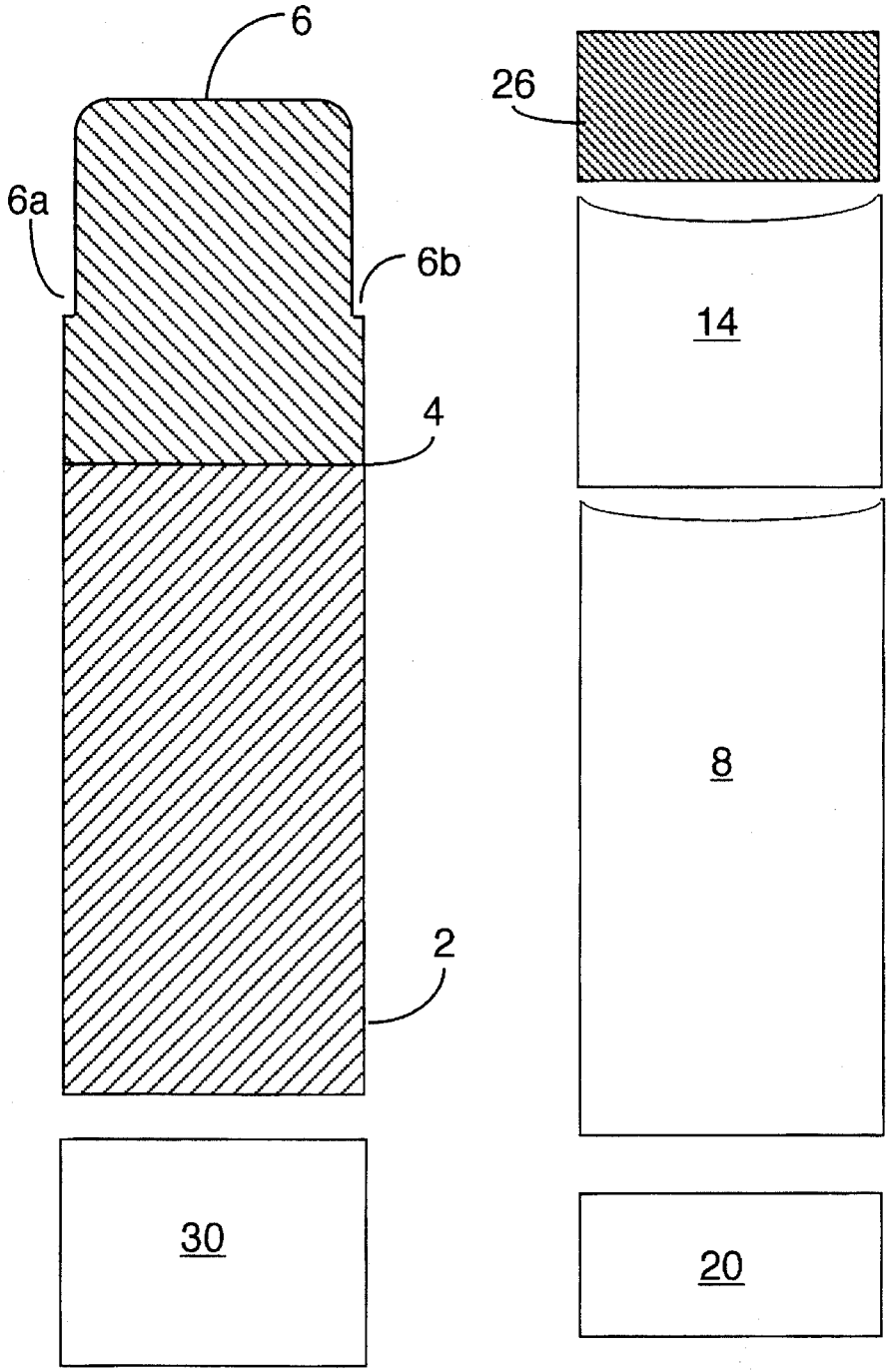
FIG. 6 is a component layout of a three pocket game card holder.
Figure 7:
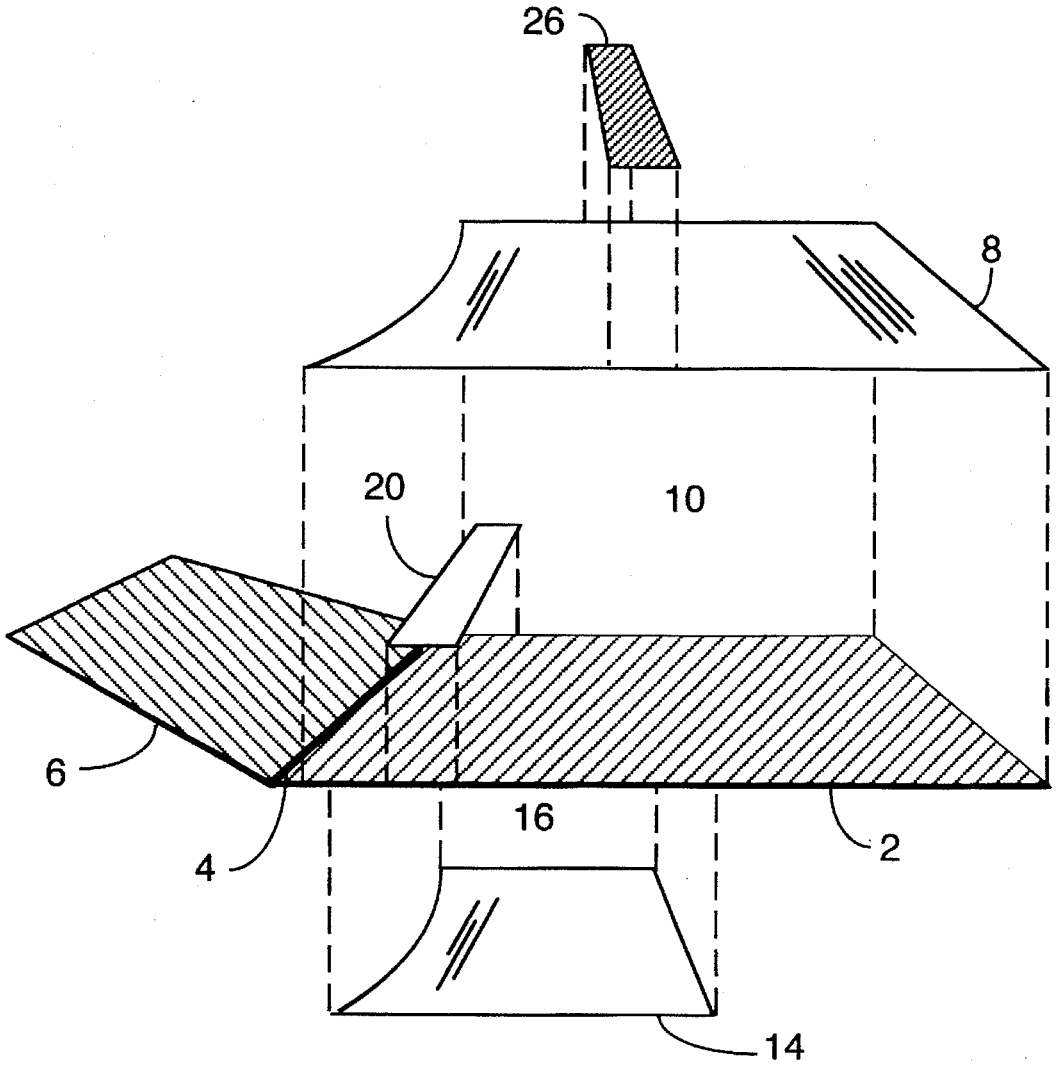
FIG. 7 is a perspective view of a two pocket game card holder having an outer cover with pocket disposed on opposing sides thereof.

Preferably the first pocket cover 8, the second pocket cover 14, and the third pocket cover 30 are clear vinyl having a gauge thickness ranging from about 0.08 to 0.18, whereas the outer cover 2 is opaque or colored vinyl having a gauge thickness ranging from about 0.08 to 0.18. Physical dimensions for a game card holder 11 appointed to protect lottery tickets and game boards sold in New Jersey are shown in FIG. 6.

The process for fabricating the game card holder 11 requires die cutting from sheet or roll stock the individual pieces as shown in FIG. 5. Thereafter, a two step, two sealing die operation is carried out. The first sealing step attaches the second pocket cover 14 to the first pocket cover 8. One type of die suited for this step is a single brass bar. During then first sealing step, a seal is applied along the lower edge of the second pocket cover 14, and 3 ¼" (for a New Jersey's ticket and game board holder) up from the bottom of the first pocket cover 8. Preferably, this step is carried out with a minimum of 5 units side by side (5 up).

The second sealing step, utilizing separate tooling, heat seals all of the components together forming the finished, but not decorated game card holder. The specifications for the sealing die for the finished product are exactly those of the outer dimensions holder. Preferably, this die is also constructed in brass and mounted on an aluminum plate. The plate is then mounted to the heat sealing machine. Preferably, heat sealing is performed by radio frequency being transmitted through the sealing die. Alternatively, acoustic, or resistive heat sealing is utilized. In order to seal the components in their proper location, a tray or gig is required for each sealing die. The tray for the first sealing process simply positions the smaller die cut piece of vinyl in place for the sealing bar to heat seal the two pieces together. The second tray would hold the cover material, the large pocket divider, the sealed clear pockets and, the belt loop (all in the order presented here) in their proper location for the final sealing process.

Preferably, the decoration of the game card holder is accomplished by hot stamping, followed by screen printing. Alternatively, debossing or embossing, and pad printing are used.

The invention has been described in detail with particular reference to the preferred embodiments thereof, but it will be understood that additional variations and modifications may suggest themselves to one skilled in the art, all falling within the scope of the invention as defined by the subjoined claims.

What is claimed is:

1. A game card holder, comprising:

(a) an outer cover having a crease and a folding flap;

(b) a first pocket cover permanently bound along three edges to said outer cover and defining therewith a first pocket having an opening therein for receiving a plurality of large game cards, said first pocket cover having a length substantially equal to the length of said outer cover minus the length of said flap;

(c) a second pocket cover permanently bound along three edges to said first pocket cover and forming therewith a second pocket for receiving a plurality of small game cards, said second pocket having a length less than the length of said first pocket; and (c) a pocket divider having a pair of opposite edges permanently bound between said outer cover and said first pocket cover for dividing said opening of said first pocket in half.

2. A game card holder as recited in claim 1, further comprising a belt loop for receiving said flap.

3. A game card holder as recited in claim 1, wherein said outer cover, said first pocket cover, and said second pocket cover are comprised of vinyl having a gauge thickness ranging from 0.08 to 0.18.

4. A game card holder as recited in claim 1, wherein said first pocket cover, and said second pocket cover are comprised of clear vinyl.

5. A game card holder, comprising:

(a) a outer cover having a crease and a folding flap;

(b) a first pocket cover permanently bound along three edges to said outer cover and defining therewith a first pocket having an opening therein for receiving a plurality of large game cards, said first pocket cover having a length substantially equal to the length of said outer cover minus the length of said flap;

(c) a second pocket cover permanently bound along three edges to said first pocket cover and forming therewith a second pocket for receiving a plurality of small game cards, said second pocket having a length less than the length of said first pocket;

(d) a third pocket cover permanently bound along three edges to said first pocket cover and defining therewith a third pocket open along a fourth edge of said third pocket cover for receiving a plurality of business cards, the combined length of said second pocket cover and said third pocket cover being at most equal to the length of said outer cover minus the length of said flap; and (e) a pocket divider having a pair of opposing edges permanently bound between said outer cover and said first pocket cover for dividing said opening of said first pocket in half.

6. A game card holder as recited in claim 5, further comprising a belt loop for receiving said flap.

7. A game card holder as recited in claim 5, wherein said outer cover, said first pocket cover, said second pocket cover, and said third pocket cover are comprised of vinyl having gauge thickness ranging from 0.08 to 0.18.

8. A game card holder as recited in claim 5, wherein said first pocket cover, said second pocket cover, and said third pocket cover are comprised of clear vinyl.

9. A game card holder, comprising:

(a) an outer cover having a first and second side and a folding flap;

(b) a first pocket cover permanently bound along three edges to said first side of said outer cover and defining therewith a first pocket having an opening therein for receiving a plurality of large game cards, said first pocket cover having a length substantially equal to the length of said cover minus the length of said flap;

(c) a second pocket cover permanently bound along three edge side of said outer cover and forming therewith a second pocket for receiving a plurality of small game cards, said second pocket being located on said second side of said outer cover, thereby providing said outer cover with pockets on opposing sides thereof; and (d) a belt loop for receiving said flap.

10. A game card holder as recited in claim 9, wherein said outer cover, said first pocket cover, and said second pocket cover are comprised of vinyl having a gauge thickness ranging from 0.08 to 0.18.

11. A game card holder as recited in claim 9, wherein said first pocket cover, and said second pocket cover are comprised of clear vinyl.

12. A game card holder as recited in claim 9, further comprising a third pocket cover permanently bound along three edges to said second side of said outer cover and forming therewith a third pocket for receiving a plurality of business cards, the combined length of said second pocket cover and said third pocket cover being at most equal to the length of said outer cover.

13. A game card holder as recited in claim 12, wherein said third pocket cover is comprised of clear vinyl having a gauge thickness ranging from 0.08 to 0.18.

14. A game card holder as recited in claim 2, wherein said folding flap is provided with indents located at opposing ends of said crease, for facilitating the insertion of said folding flap under said belt loop and the folding of said folding flap at said crease.

15. A game card holder as recited in claim 6, wherein said folding flap is provided with indents located at opposing ends of said crease, for facilitating the insertion of said folding flap under said belt loop and the folding of said folding flap at said crease.

16. A game card holder as recited in claim 9, wherein said folding flap is provided with indents located at opposing ends of said crease, for facilitating the insertion of said folding flap under said belt loop and the folding of said folding flap at said crease.

* * * * *